US012455108B2

(12) United States Patent
Li et al.

(10) Patent No.: US 12,455,108 B2
(45) Date of Patent: Oct. 28, 2025

(54) REFRIGERATOR DOOR WITH REPLACEABLE DOOR SURFACE

(71) Applicants: QINGDAO HAIER SPECIAL REFRIGERATOR CO., LTD., Qingdao (CN); QINGDAO HAIER REFRIGERATOR CO., LTD., Qingdao (CN); HAIER SMART HOME CO., LTD., Qingdao (CN)

(72) Inventors: Jiaming Li, Qingdao (CN); Hao Zhang, Qingdao (CN); Zhiwei Ren, Qingdao (CN); Peng Lv, Qingdao (CN)

(73) Assignees: QINGDAO HAIER SPECIAL REFRIGERATOR CO., LTD., Qingdao (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 328 days.

(21) Appl. No.: 18/020,619

(22) PCT Filed: Sep. 9, 2021

(86) PCT No.: PCT/CN2021/117339
§ 371 (c)(1),
(2) Date: Feb. 9, 2023

(87) PCT Pub. No.: WO2022/033603
PCT Pub. Date: Feb. 17, 2022

(65) Prior Publication Data

US 2023/0314061 A1 Oct. 5, 2023

(30) Foreign Application Priority Data

Aug. 10, 2020 (CN) ..... 202010794986.X

(51) Int. Cl.
*F25D 23/02* (2006.01)

(52) U.S. Cl.
CPC ..... *F25D 23/028* (2013.01)

(58) Field of Classification Search
CPC .... F25D 23/02; F25D 23/028; F25D 2201/12; F25D 2400/18; F16B 21/165;
(Continued)

(56) References Cited

U.S. PATENT DOCUMENTS 3,052,940 A * 9/1962 Sellers ..... F16B 21/165 411/348
3,124,501 A * 3/1964 Wise ..... B44C 5/0415 428/167

(Continued)

FOREIGN PATENT DOCUMENTS

CN 2833308 Y 11/2006
CN 101231101 A 7/2008

(Continued)

*Primary Examiner* — James M Ference
(74) *Attorney, Agent, or Firm* — Cheng-Ju Chiang

(57) ABSTRACT

A refrigerator door with a replaceable door surface includes a foamed door body and a decorative door plate. A rear side of the decorative door plate is provided with a mater; a front side of the foamed door body is provided with a magnetic lock catch, which comprises a plurality of balls. By clamping the mater on the rear side of the decorative door plate by the plurality of balls of the magnetic lock catch in the foamed door body, the displacement of the decorative door plate in the front-rear direction is limited. In addition, the unlocking magnetic buckle is provided to repel with the magnetic ring, such that a locking relationship between the plurality of balls and the mater is released, thereby achieving the effect of quickly disassembling and installing the decorative door plate.

7 Claims, 8 Drawing Sheets

(58) Field of Classification Search
CPC ..... F16B 2200/83; E05B 65/0042; E04F 13/083; E04F 13/088; E04F 13/0883
USPC ..... 52/784.15
See application file for complete search history.

(56) References Cited

U.S. PATENT DOCUMENTS 3,642,164 A * 2/1972 O'Neal ..... F25D 23/00 49/495.1
3,658,370 A * 4/1972 Wang ..... B64D 11/0629 292/201
3,708,997 A * 1/1973 McLaughlin ..... F25D 19/00 62/298
4,016,914 A * 4/1977 Zurko ..... F16B 21/165 411/105
4,453,449 A * 6/1984 Hollmann ..... F41F 3/052 403/322.2
4,906,123 A * 3/1990 Weskamp ..... B23Q 1/0072 403/322.2
4,987,754 A * 1/1991 Minasy ..... E05B 73/0052 70/57.1
5,007,226 A * 4/1991 Nelson ..... F25D 23/02 52/784.15
5,048,233 A * 9/1991 Gidseg ..... F25D 23/02 49/501
5,061,112 A * 10/1991 Monford, Jr. ..... F16B 21/183 403/DIG. 1
6,067,738 A * 5/2000 Zeligson ..... G09F 7/02 40/606.03
8,366,221 B2 * 2/2013 Kim ..... F25D 23/02 312/405
8,439,461 B2 * 5/2013 Kim ..... F25D 23/02 312/405
8,567,885 B2 * 10/2013 Lee ..... E05D 7/0027 312/405
9,435,579 B1 * 9/2016 House ..... E05D 7/081
10,823,483 B1 * 11/2020 Baylor ..... F25D 23/028
2002/0066258 A1 * 6/2002 Oishi ..... F25D 23/02 52/784.15
2003/0170594 A1 * 9/2003 Anderson ..... B44C 1/10 434/80
2007/0188059 A1 * 8/2007 Davis ..... F24C 15/045 312/265.6
2008/0164226 A1 * 7/2008 McCoy ..... F25D 23/12 211/26.1
2008/0165282 A1 * 7/2008 Marcy ..... F25D 23/12 62/331
2008/0165474 A1 * 7/2008 McCoy ..... H05K 5/0017 361/728
2008/0165475 A1 * 7/2008 McCoy ..... H05K 5/0017 361/729
2008/0165476 A1 * 7/2008 McCoy ..... F25D 23/12 361/728
2008/0165509 A1 * 7/2008 Kendall ..... F25D 23/028 361/729
2008/0166895 A1 * 7/2008 McCoy ..... F25D 23/028 439/11
2008/0252186 A1 * 10/2008 Crompton ..... F25D 23/10 312/204
2008/0278049 A1 * 11/2008 Park ..... E05F 5/00 29/890.035
2008/0297019 A1 * 12/2008 Kim ..... F25D 23/02 312/405
2008/0303400 A1 * 12/2008 Kim ..... F25D 23/02 312/401
2009/0009043 A1 * 1/2009 Gwak ..... E05C 1/145 312/405.1
2009/0045705 A1 * 2/2009 Laible ..... A47B 96/20 312/204
2010/0287975 A1 * 11/2010 Lim ..... F25D 23/02 62/449
2010/0295425 A1 * 11/2010 Kim ..... F25D 27/00 428/210
2010/0327720 A1 * 12/2010 Pae ..... F25D 23/028 49/70
2011/0089790 A1 * 4/2011 Lee ..... F25D 23/02 29/890.035
2011/0209509 A1 * 9/2011 Nickeas ..... E05B 47/0045 70/276
2012/0169196 A1 * 7/2012 Marchetti ..... E06B 5/006 312/265.6
2013/0026900 A1 * 1/2013 Oh ..... E05D 7/00 312/401
2013/0033163 A1 * 2/2013 Kang ..... F25D 23/04 312/405.1
2013/0164483 A1 * 6/2013 Cites ..... B32B 3/04 428/68
2013/0323461 A1 * 12/2013 Shim ..... B32B 3/08 264/510
2014/0096467 A1 * 4/2014 Norton ..... E04F 13/0833 52/582.2
2018/0164026 A1 * 6/2018 Lee ..... A47F 3/0434
2018/0164031 A1 * 6/2018 Lee ..... F25D 11/00
2018/0164033 A1 * 6/2018 Lee ..... F25D 29/005
2018/0274852 A1 * 9/2018 Kang ..... F25D 23/025
2019/0383068 A1 * 12/2019 Konrad ..... E05C 1/08
2020/0326119 A1 * 10/2020 Lee ..... F25D 23/02
2021/0071935 A1 * 3/2021 Lee ..... F25D 23/02
2023/0251020 A1 * 8/2023 Li ..... F25D 23/028 49/501
2023/0251021 A1 * 8/2023 Li ..... F25D 23/028 49/501
2023/0251022 A1 * 8/2023 Li ..... F25D 23/028 49/501
2023/0251023 A1 * 8/2023 Li ..... F25D 23/02 312/401
2023/0251024 A1 * 8/2023 Wang ..... F25D 23/02
2023/0258385 A1 * 8/2023 Wang ..... F25D 23/028 49/501
2023/0258386 A1 * 8/2023 Wang ..... F25D 23/028
2023/0280084 A1 * 9/2023 Wang ..... F25D 23/028
2023/0314061 A1 * 10/2023 Li ..... F25D 23/028 312/401
2023/0324104 A1 * 10/2023 Li ..... F25D 23/02 312/405

FOREIGN PATENT DOCUMENTS

CN 101259609 A 9/2008
CN 106091552 A 11/2016
CN 207763338 U 8/2018
CN 207936603 U 10/2018
CN 208344133 U 1/2019
CN 210119057 U 2/2020
CN 110939338 A 3/2020
CN 210220367 U 3/2020
CN 210249367 U 4/2020
CN 210616472 U 5/2020
DE 4334761 A1 4/1995
DE 202007001638 U1 4/2007
JP 2002-333267 A 11/2002
JP 2014-52175 A 3/2014
JP 2015-230138 A 12/2015
WO 2005/024316 A1 3/2005
WO 2016/106800 A1 7/2016

* cited by examiner

REFRIGERATOR DOOR WITH REPLACEABLE DOOR SURFACE

CROSS REFERENCE TO RELATED APPLICATIONS

The present invention is a 35 U.S.C. § 371 National Phase conversion of International (PCT) Patent Application No. PCT/CN2021/117339, filed on Sep. 9, 2021, which claims benefit of Chinese Application No. 202010794986.X, filed on Aug. 10, 2020, the disclosure of which is incorporated by reference herein. The PCT International Patent Application was filed and published in Chinese.

TECHNICAL FIELD

The present invention relates to the technical field of household appliances, and in particular to a refrigerator door with a replaceable door surface.

BACKGROUND

With the continuous development of science and technology, refrigerators have become one of indispensable household appliances. In existing applications, with the increasingly higher requirements of user needs, refrigerators are not only used as household appliances, but also as decorations in the family environment. Before buying a refrigerator, a user usually has many requirements for the color and pattern of the appearance of the refrigerator, but the monotonous appearance of the refrigerator affects the purchasing needs of the user. In addition, because the service life of the refrigerator can usually reach 8 to 10 years, the appearance of the refrigerator cannot meet the long-term adjustment need of the user during his/her use with the change of environment and scene after the single-time purchase of the refrigerator. In another case, there is also a risk of door surface breakage during the use and transportation of the refrigerator. In the several cases above, if the entire door body of the refrigerator is replaced, the replacement cost is high, and the use of the refrigerator is affected, which is not conducive to meeting the needs of consumers.

SUMMARY

An object of the present invention is to provide a refrigerator door with a replaceable door surface, in order to solve the problem that the refrigerator door in the prior art is difficult to replace or has high replacement cost.

In order to achieve one of the above object, an embodiment of the present invention provides a refrigerator door with a replaceable door surface, comprising:

- a foamed door body and a decorative door plate detachably connected to the foamed door body;
- wherein a rear side of the decorative door plate is provided with a mater; a front side of the foamed door body is provided with a magnetic lock catch, which comprises a plurality of balls; and
- when the decorative door plate is assembled on the front side of the foamed door body, the mater is inserted in the magnetic lock catch, and the plurality of balls clamps the mater to limit the displacement of the decorative door plate in a front-rear direction.

As an optional embodiment, wherein the magnetic lock catch further comprises a housing and a holding frame, which is assembled inside the housing; the holding frame comprises an axial through hole and a plurality of radial through holes, and the axial through hole and the plurality of radial through holes are communicated with each other; the plurality of balls is respectively accommodated in the plurality of radial through holes; and wherein the mater is inserted in the axial through hole, and a side wall inside the housing limits the displacement of the plurality of balls in a vertical direction, such that the plurality of balls clamps the mater.

As an optional embodiment, wherein the magnetic lock catch further comprises a magnetic ring and an elastic member; the magnetic ring is disposed on a front end of the holding frame; and the elastic member is disposed on a rear end of the holding frame.

As an optional embodiment, wherein the magnetic lock catch further comprises an unlocking magnetic buckle having the same magnetic polarity as that of the magnetic ring; and wherein, when the unlocking magnetic buckle is close to the magnetic ring, the magnetic ring pushes the holding frame, which compresses the elastic member and moves backwards axially, and the plurality of balls is moved out of the plurality of radial through holes, such that the clamping between the plurality of balls and the mater is released.

As an optional embodiment, wherein when the unlocking magnetic buckle is away from the magnetic ring, the compressed elastic member is restored, the holding frame moves forwards axially, and the plurality of balls falls in the plurality of radial through holes.

As an optional embodiment, wherein the housing comprises a front cover, which comprises a front panel and an extension portion, the extension portion being located on a rear side of the front panel and protruding outwards, and the front panel being provided with a cross hole; the extension portion has an accommodation cavity; the cross hole is communicated with the accommodation cavity; the magnetic ring, the holding frame, the plurality of balls, and the elastic member are disposed in the accommodation cavity in sequence; and wherein the magnetic ring is located on a front end of the accommodation cavity and close to the front panel.

As an optional embodiment, wherein the housing further comprises a rear cover; the front cover matches with a front side of the rear cover; the rear cover has an assembly cavity; the extension portion is inserted in the assembly cavity; and a rear end of the extension portion is close to a rear wall of the assembly cavity.

As an optional embodiment, wherein one end of the elastic member is abutted against the rear wall of the assembly cavity.

As an optional embodiment, wherein when the mater is inserted in the cross hole, the magnetic ring, and the axial through hole of the holding frame, the plurality of balls clamps the mater, and an inner wall of the extension portion limits the displacement of the plurality of balls in the vertical direction.

As an optional embodiment, wherein the mater is a hanging pin disposed on the rear side of the decorative door plate; and the hanging pin comprises a recess, in which the plurality of balls is clamped.

Compared with the prior art, the present invention provides the refrigerator door with the replaceable door surface, in which the displacement of a decorative door plate 10 in the front-rear direction is limited by clamping a mater on the rear side of the decorative door plate by a plurality of balls of a magnetic lock catch in a foamed door body. In addition, the unlocking magnetic buckle having the same magnetic polarity as the magnetic polarity of the magnetic ring in the magnetic lock catch is provided to repel with the magnetic ring, such that a locking relationship between the plurality of balls and the mater is released, thereby achieving the effect of quickly disassembling and installing the decorative door plate.

DETAILED DESCRIPTION

Figure 1:
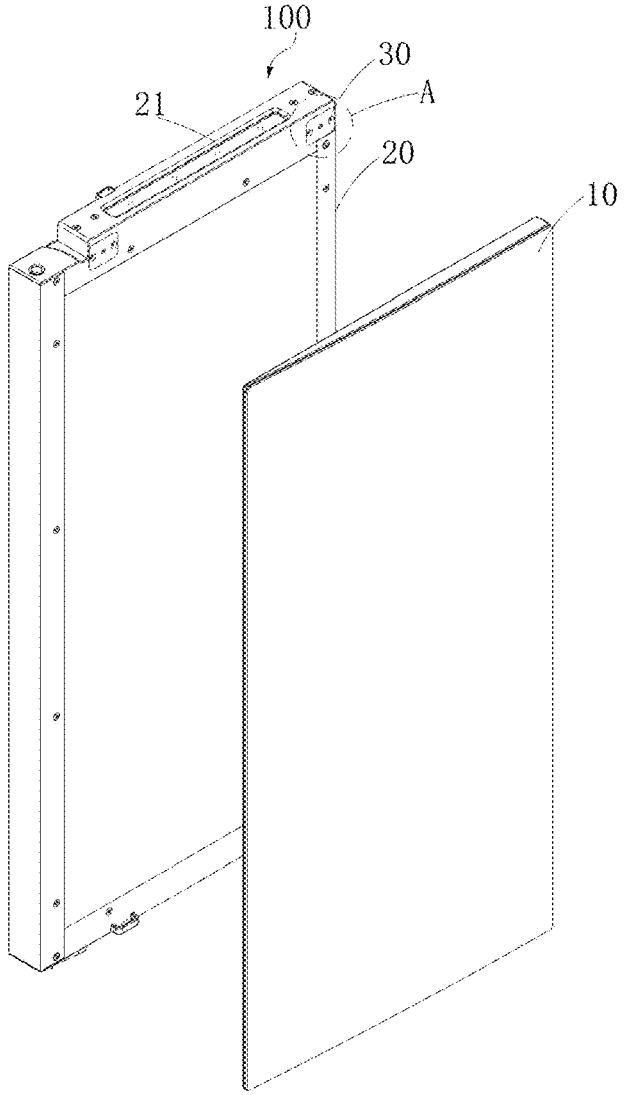
FIG. 1 is a schematic exploded view of a refrigerator door with a replaceable door surface according to the present invention.

The present invention will be described in detail below in conjunction with the specific embodiments shown in the accompanying drawings. However, these embodiments are not intended to limit the present invention, and any changes made by those of ordinary skills in the art to the structures, methods or functions according to these embodiments shall fall within the protection scope of the present invention.

As shown in FIGS. 1 to 6, a refrigerator door 100 with a replaceable door surface includes a foamed door body 20 and a decorative door plate 10 detachably connected to the foamed door body 20. The rear side of the decorative door plate 10 is provided with a mater 40; and the front side of the foam door body 10 is provided with a magnetic lock catch 30, which includes a plurality of balls 321. When the decorative door plate 10 is assembled on the front side of the foamed door body 20, the mater 40 is inserted in the magnetic lock catch 30, and the plurality of balls 321 clamps the mater 40 to limit the displacement of the decorative door plate 10 in a front-rear direction.

Figure 4:
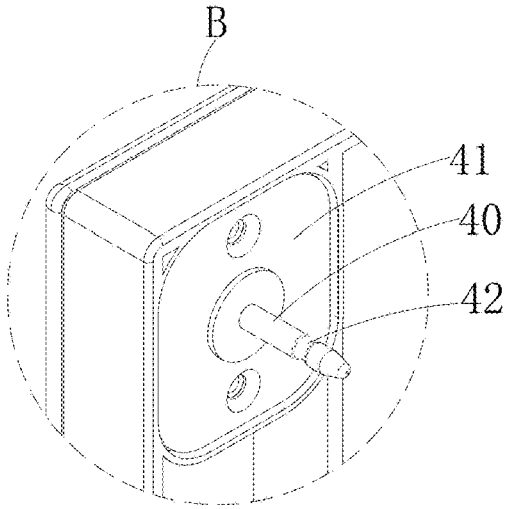
FIG. 4 is a schematic enlarged view at a dashed line B in FIG. 3.

As shown in FIG. 4, the mater 40 is a hanging pin disposed on the rear side of the decorative door plate 10. The hanging pin is locked and attached to the rear side of the decorative door plate 10 by a connecting plate 41, and a front end of the hanging pin includes a recess 42, which is disposed around an outer surface of the hanging pin.

Figure 2:
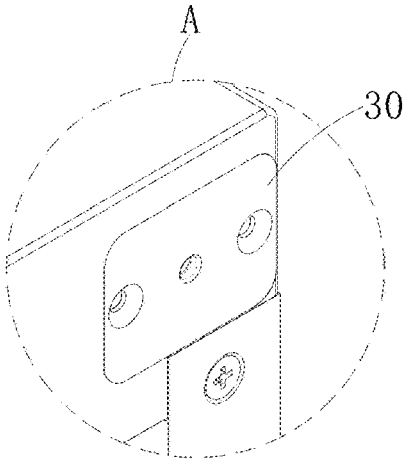
FIG. 2 is a schematic enlarged view at a dashed line A in FIG. 1.
Figure 3:
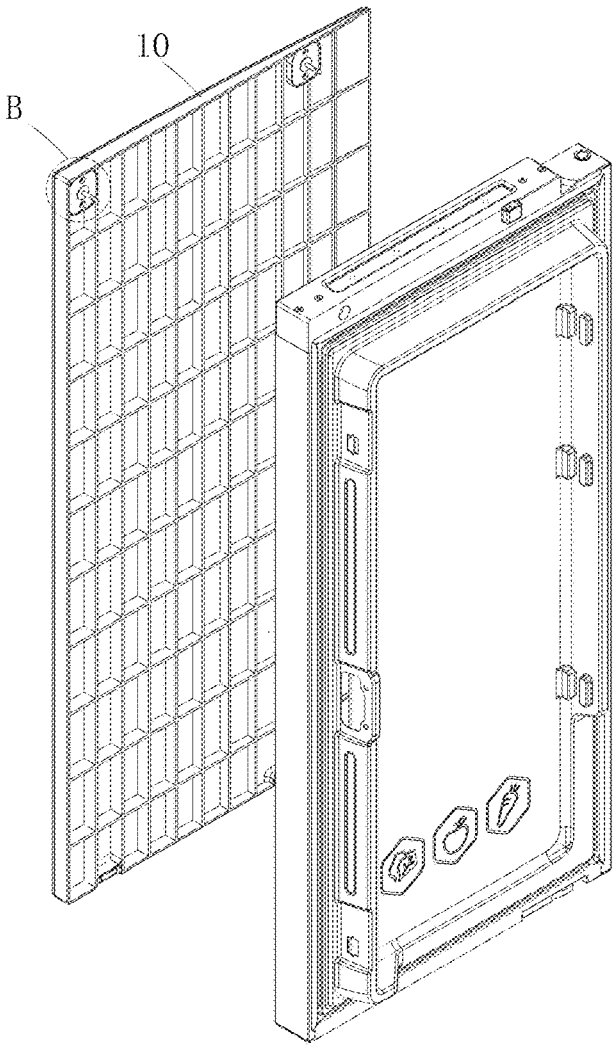
FIG. 3 is a schematic exploded view of the refrigerator door with the replaceable door surface in FIG. 1 from another view of angle.
Figure 5:
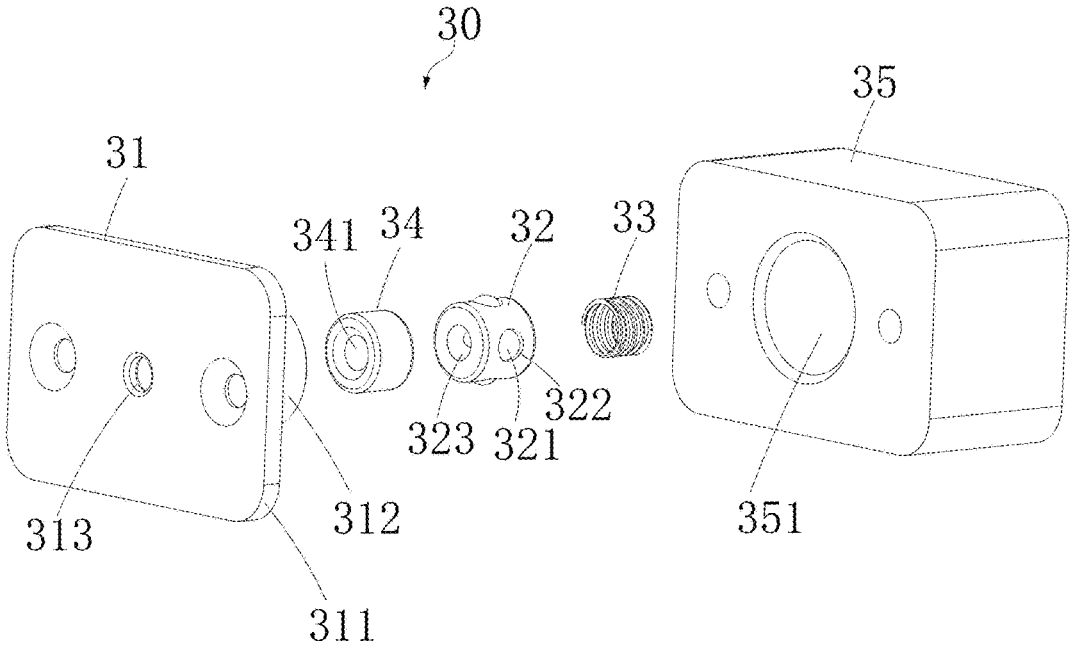
FIG. 5 is a schematic exploded view of a magnetic lock catch in FIG. 1.
Figure 6:
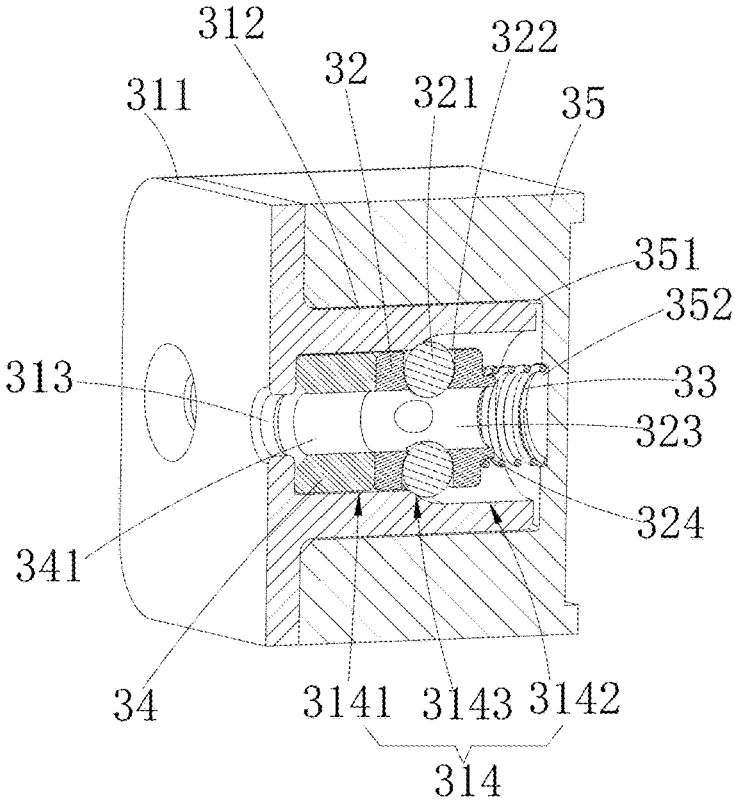
FIG. 6 is a schematic sectional view of an assembly of the magnetic lock catch in FIG. 5.

As shown in FIGS. 2, 5 and 6, the magnetic lock catch 30 includes a housing and a holding frame 32, which is assembled inside the housing. The holding frame 32 includes an axial through hole 323 and a plurality of radial through holes 322, which is respectively communicated with the axial through hole 323. A plurality of balls 321 are respectively accommodated in the plurality of radial through holes 322.

The displacement of the plurality of balls 321 in a vertical direction is limited by a side wall inside the housing, such that when the hanging pin is inserted in the axial through hole 323 of the holding frame 32 of the magnetic lock catch 30, the plurality of balls 321 is snapped into the recess 43 in the front end of the hanging pin, and the hanging pin and the magnetic lock catch 30 are locked with each other.

In this embodiment, when the balls 321 are accommodated in the radial through holes 322, outside portions of the balls 321 protrude from the outer wall of the holding frame 32, and inside portions of the baits 321 protrude from the inner wall of the holding frame 32, Here, the inner wall of the holding frame 32 is a hole wall of the axial through hole 323. That is, the balls 321 are accommodated in the radial through holes 322, and the balls 321 protrude from the outer wall of the holding frame 32 and the hole wall of the axial through hole 323, respectively.

Further, the housing of the magnetic lock catch 30 includes a front cover 31 and a rear cover 35, which are opposite to each other. The front cover 31 includes a front panel 311 and an accommodation portion 312, which are formed integrally. The accommodation portion 312 is located on the rear side of the front panel 311 and extends towards the rear cover 35. Corresponding to the accommodation portion 312, the rear cover 35 is provided with an assembly cavity 351. When the front cover 31 is assembled on the front side of the rear cover 35, the accommodation portion 312 is inserted into the assembly cavity 351, and a rear end of the accommodation portion 312 is close to a rear wall of the assembly cavity 351.

The front panel 311 is provided with a cross hole 313; the accommodation portion 312 is provided with an accommodation cavity 314; and the cross hole 313 and the accommodation cavity 314 are communicated with each other. In this embodiment, the accommodation cavity 314 has a through-hole structure.

As shown in FIGS. 5 and 6, the magnetic lock catch 30 further includes a magnetic ring 34 and an elastic member 33. The magnetic ring 34 and the elastic member 33 are disposed on both sides of the holding frame 32. Here, the magnetic ring 34, the holding frame 32, and the elastic member 33 are accommodated in the accommodation cavity 314 of the accommodation portion 312 of the front cover 31, respectively. The magnetic ring 34 is close to the front panel 311, and a rear end of the elastic member 33 is abutted against a groove 352 in the rear wall of the assembly cavity 351.

In addition, a rear end of the holding frame 32 protrudes from an extension portion 324; and a front end of the elastic member 33 is sleeved on the extension portion 324 and elastically abutted against the rear end of the holding frame 32.

In this embodiment, the plurality of balls 321 are pre-assembled in the radial through holes 322 in the holding frame 32. The magnetic ring 34, the holding frame 32 and the elastic member 33 are then assembled in sequence in the accommodation cavity 314 of the accommodation portion 312 of the front cover 31. Then, the accommodation portion 312 of the front cover 31 is inserted into the assembly cavity 351 of the rear cover 35. At this time, the rear end of the elastic member 33 is limited in the groove 352 in the rear wall of the assembly cavity 351.

As shown in FIG. 6, the accommodation cavity 314 includes a first section 3141, a second section 3142, and a third section 3143 connecting the first section 3141 and the second section 3142. The inner diameter of the first section 3141 is less than the inner diameter of the second section 3142.

In this embodiment, the third section 3143 is approximately a conical structure; a front end of the conical structure is connected to a rear end of the first section 3141; and a rear end of the conical structure is connected to a front end of the second section 3142. Here, the inner diameter of the front end of the conical structure is approximately equal to the inner diameter of the first section 3141, and the inner diameter of the rear end of the conical structure is approximately equal to the inner diameter of the second section 3142.

It should be noted that the accommodation cavity 314 is divided into the first section 3141, the second section 3142 and the third section 3143 for the purpose of better illustrating the internal structure of the accommodation cavity 314. In an actual product, it can be regarded that the accommodation cavity 314 is formed by two hollow cylinders of different inner diameters, and a front end of the hollow cylinder with a larger inner diameter is approximately arc-shaped.

Still referring to FIG. 6, the magnetic ring 34 is accommodated in the first section 3141; the front end of the holding frame 32 is accommodated in the first section 3141; and the balls 321 on the holding frame 32 and the rear end of the holding frame 32 are accommodated in the third section 3143 and the second section 3142, respectively. Here, the displacements of the plurality of balls 321 in the vertical direction are limited by the third section 3143, respectively. Because the inner diameter of the first section 3141 is the smallest, the plurality of balls 321 will not cross the third section 3143 and move towards the first section 3141, during the assembly and disassembly of the hanging pin.

The assembly and disassembly processes for the decorative door plate 10 and foamed door body 20 of the present invention will be illustrated below with reference to FIGS. 7 to 11.

Figure 7:
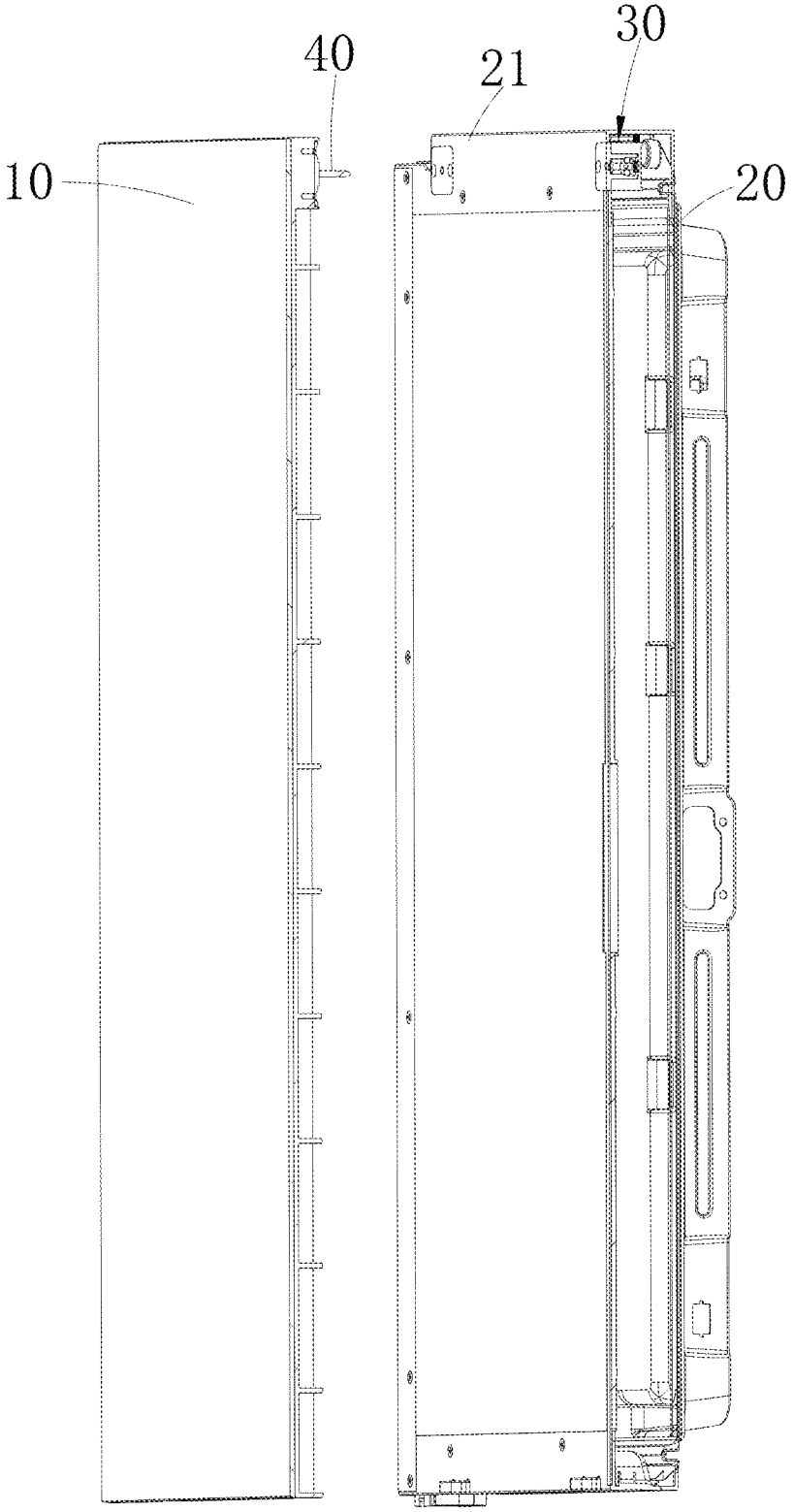
FIGS. 7 to 8 are schematic sectional views of an assembly process for a refrigerator door with a replaceable door surface according to the present invention.
Figure 8:
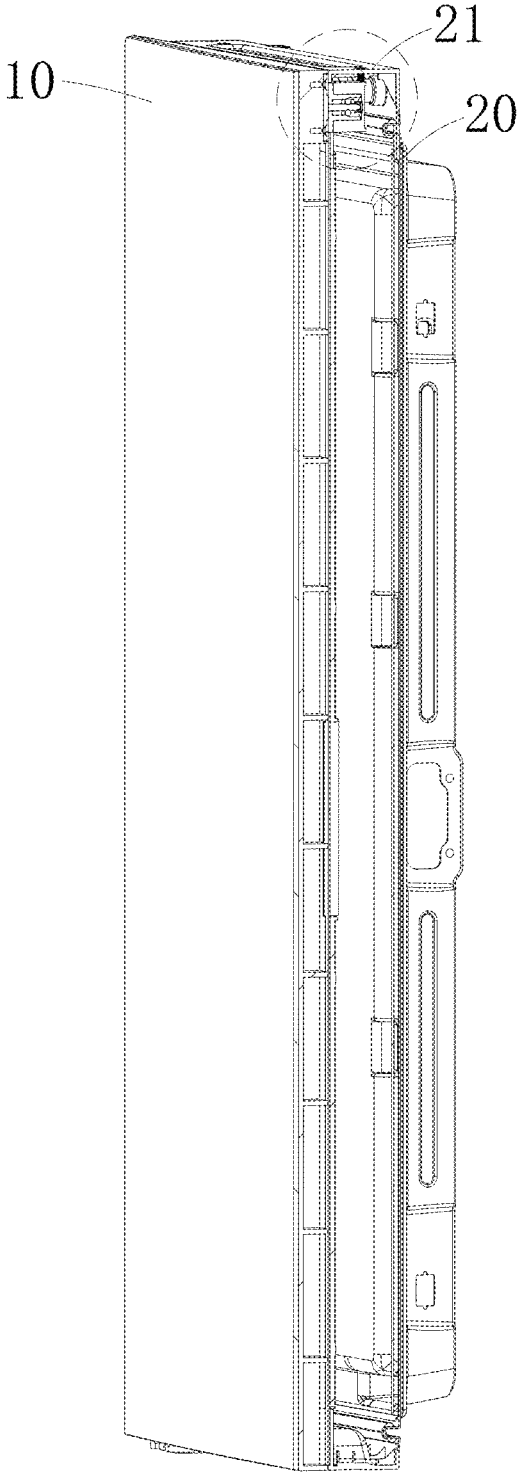
Figure 9:
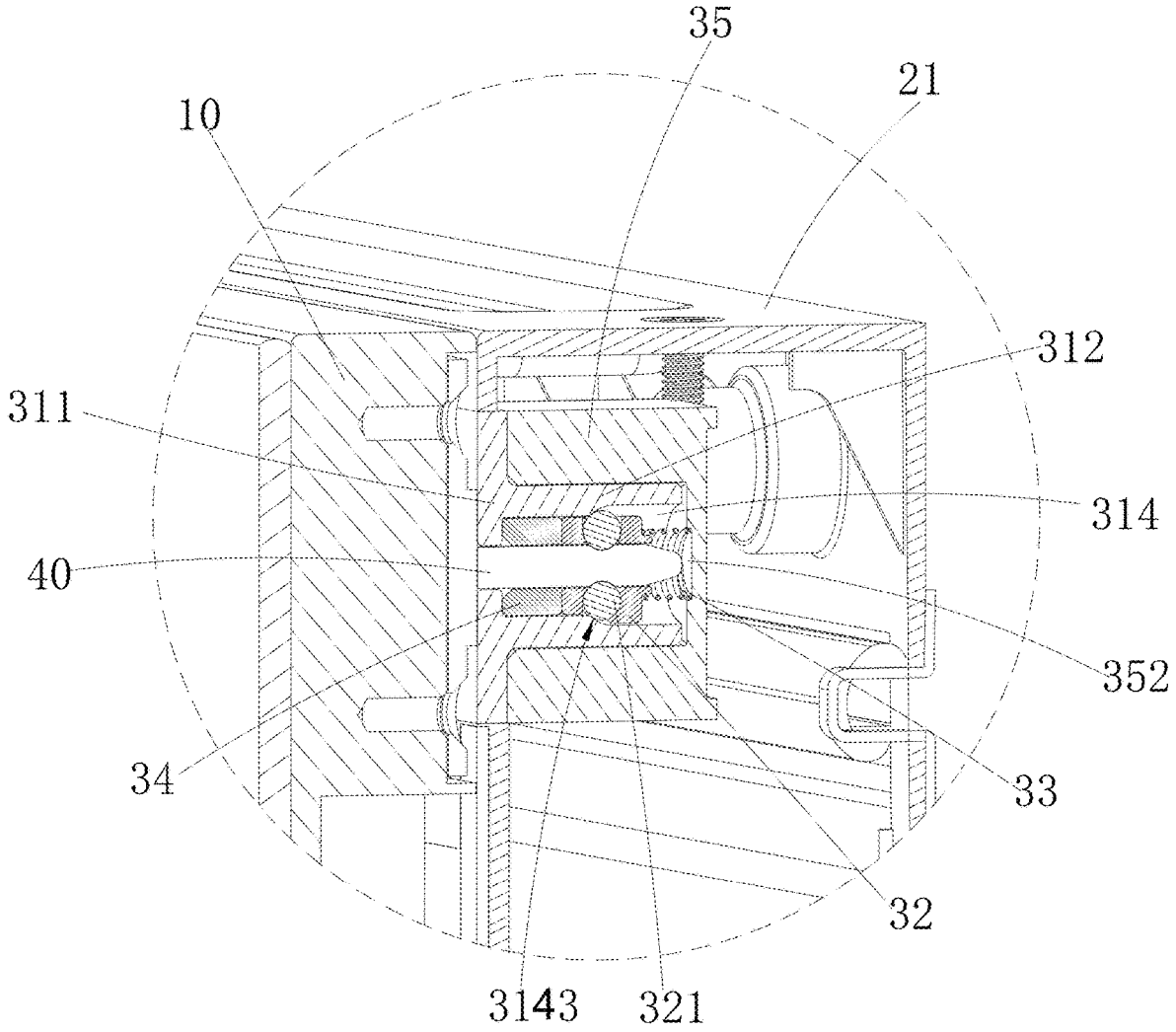
FIG. 9 is a schematic enlarged view at a dashed line in FIG. 8.

As shown in FIGS. 7 to 9, the decorative door plate 10 is moved towards the front side of the foamed door body 20, and the hanging pin (mater 40) on the rear side of the decorative door plate 10 is inserted in the magnetic lock catch 30 on the front side of an upper trim strip 21 of the foamed door body 20.

Specifically, the hanging pin sequentially passes through the cross hole 312 in the front panel 311, and enters a hole portion 341 of the magnetic ring 34 and the axial through hole 323 of the holding frame 32. The plurality of balls 321 in the plurality of radial through holes 322 of the holding frame 32 is respectively snapped into the recess 43 in the front end of the hanging pin. Then, the hanging pin is clamped by the plurality of balls 321, and is locked by the magnetic lock catch. At this time, the decorative door plate 10 is assembled on the front side of the foamed door body 20. By virtue of the plurality of balls 321 snapped into the recess 43 of the hanging pin, the displacement of the decorative door plate 10 in the front-rear direction is limited.

Figure 10:
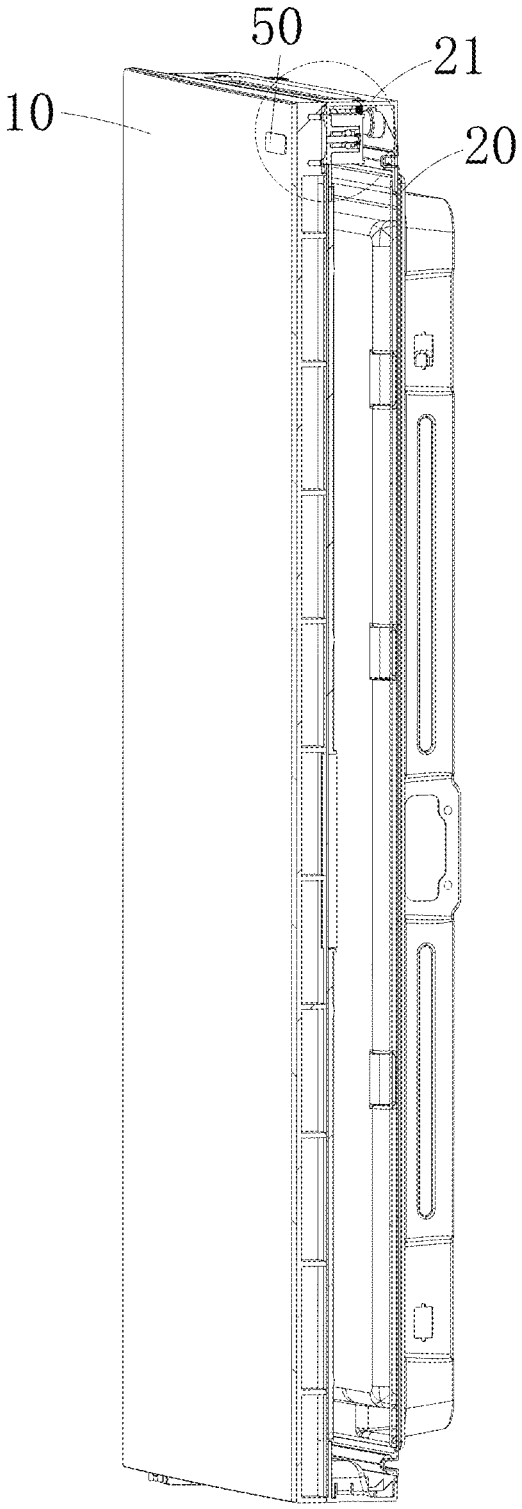
FIG. 10 is a schematic sectional view of a detached refrigerator door with a replaceable door surface according to the present invention.
Figure 11:
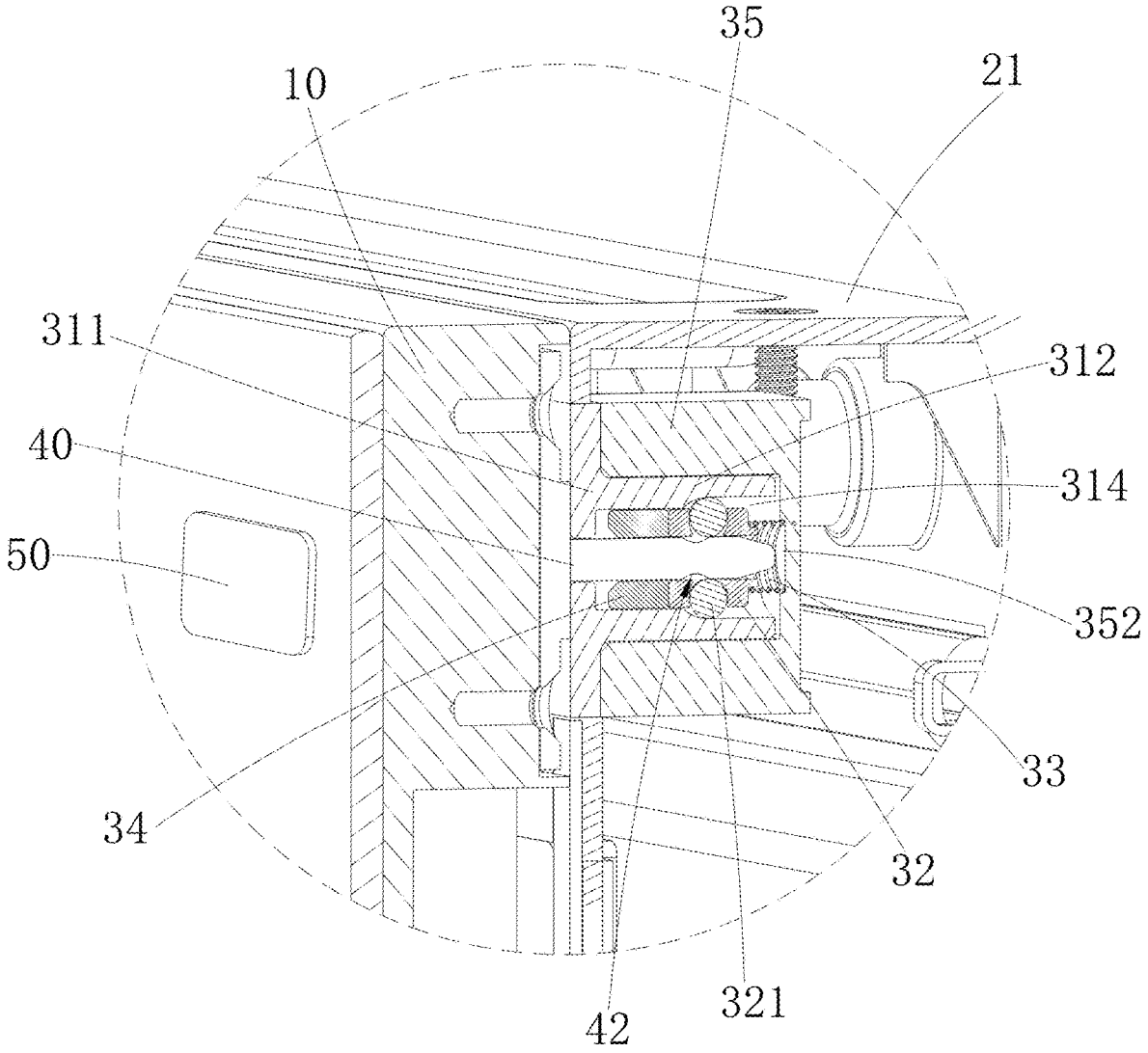
FIG. 11 is a schematic enlarged view at a dashed line in FIG. 10.

As shown in FIGS. 10 to 11, when the decorative door plate 10 needs to be disassembled from the front side of the foamed door body 20, an additional unlocking magnetic buckle 50 is provided. Here, the magnetic polarity of the unlocking magnetic buckle 50 is the same as that of the magnetic ring 34. The unlocking magnetic buckle 50 is made close to the front side of the decorative door plate 10, and the position of the unlocking magnetic buckle 50 is made to correspond to the magnetic ring 34 in the magnetic lock catch 30 on the front side of the foamed door body 20. Based on the principle that like poles of magnets repel each other, the magnetic ring 34 is moved backwards in the accommodation cavity 314 to push the holding frame 32, which presses the elastic member 33 to allow the elastic member to move backwards and drive the plurality of balls 321 to move backwards together, such that the plurality of balls 321 moves out of the recess 43 in the front end of the hanging pin, locking between the magnetic lock catch 30 and the hanging pin is released, and the restriction of the displacement of the decorative door plate 10 in the front-rear direction is removed.

In addition, by removing the detachable structure from the decorative door plate 10 and the foamed door body 20 in the vertical and horizontal directions, the hanging pin may be removed from the magnetic lock catch 30, and the decorative door plate 10 may be disassembled from the front side of the foamed door body 20.

Furthermore, the unlocking magnetic buckle 50 is removed. The elastic force of the elastic member 33 is utilized to push the holding frame 32 and the magnetic ring 34 to move forwards together in the accommodation cavity 314; and the magnetic ring 34 and the holding frame 32 are restored.

In this embodiment, in order to facilitate the user to accurately place the unlocking magnetic buckle 50 on the position of the decorative door plate 10 corresponding to the magnetic lock catch 30, the front side of the decorative door plate 10 may be provided with a marking pattern (not shown) at a position corresponding to the position of the magnetic lock catch 30 on the front side of the foamed door body 20.

Here, when not in use, the unlocking magnetic buckle 50, as a separate accessory, may be attracted to the side wall of a metal casing of the refrigerator to prevent loss.

In summary, the present invention provides the refrigerator door with the replaceable door surface, in which the displacement of the decorative door plate 10 in the front-rear direction is limited by clamping the mater on the rear side of the decorative door plate by the plurality of balls of the magnetic lock catch in the foamed door body. In addition, the unlocking magnetic buckle having the same polarity as that of the magnetic ring in the magnetic lock catch is provided to repel with the magnetic ring, such that a locking relationship between the plurality of balls and the mater is released, thereby achieving the effect of quickly disassembling and installing the decorative door plate.

It should be understood that although the present invention is described by means of embodiments in this description, each embodiment does not necessarily include only one independent technical solution. The statement mode of the description is merely for clarity, and those skilled in the art should regard the description as a whole. The technical solutions in respective embodiments may also be combined properly to create other embodiments understandable by those skilled in the art.

The series of detailed illustrations listed above are merely for specifically illustrating the feasible embodiments of the present invention, but are not intended to limit the protection scope of the present invention. Any equivalent embodiments or alternations made without departing from the technical spirit of the present invention shall fall within the protection scope of the present invention.

What is claimed is:

1. A refrigerator door with a replaceable door surface, comprising:

a foamed door body and a decorative door plate detachably connected to the foamed door body;

wherein a rear side of the decorative door plate is provided with a mater;

a front side of the foamed door body is provided with a magnetic lock catch, which comprises a plurality of balls; and when the decorative door plate is assembled on the front side of the foamed door body, the mater is inserted in the magnetic lock catch, and the plurality of balls clamps the mater to limit a displacement of the decorative door plate in a front-rear direction;

wherein the magnetic lock catch further comprises a housing and a holding frame, which is assembled inside the housing; the holding frame comprises an axial through hole and a plurality of radial through holes, and the axial through hole and the plurality of radial through holes are opened at the holding frame to respectively provide spatial access to an internal space within the holding frame; the plurality of balls is respectively accommodated in the plurality of radial through holes; and wherein the mater is inserted in the axial through hole, and a side wall inside the housing limits a displacement of the plurality of balls in a vertical direction, such that the plurality of balls clamps the mater;

wherein the magnetic lock catch further comprises a magnetic ring and an elastic member; the magnetic ring is disposed on a front end of the holding frame; and the elastic member is disposed on a rear end of the holding frame;

wherein the magnetic lock catch further comprises an unlocking magnetic buckle, the unlocking magnetic buckle comprising a first permanent magnet having a first magnetic polarity, and the magnetic ring comprising a second permanent magnet having a second magnetic polarity that has a same magnetic polarity as the first magnetic polarity; when the unlocking magnetic buckle is positioned adjacent to the magnetic ring within a repulsive magnetic interaction range, the magnetic ring is repelled by the unlocking magnetic buckle, the magnetic ring compresses the elastic member and moves backwards axially, and the plurality of balls is moved out of the plurality of radial through holes, such that the clamping between the plurality of balls and the mater is released.

2. The refrigerator door with the replaceable door surface according to claim 1, wherein when the unlocking magnetic buckle is away from the magnetic ring, the compressed elastic member is restored, the holding frame moves forwards axially, and the plurality of balls falls in the plurality of radial through holes.

3. The refrigerator door with the replaceable door surface according to claim 2, wherein the housing comprises a front cover, which comprises a front panel and an extension portion, the extension portion being located on a rear side of the front panel and protruding outwards, and the front panel being provided with a cross hole; the extension portion has an accommodation cavity; the cross hole is communicated with the accommodation cavity; the magnetic ring, the holding frame, the plurality of balls, and the elastic member are disposed in the accommodation cavity in sequence; and wherein the magnetic ring is located on a front end of the accommodation cavity and close to the front panel.

4. The refrigerator door with the replaceable door surface according to claim 3, wherein the housing further comprises a rear cover; the front cover is engaged with a front side of the rear cover; the rear cover has an assembly cavity; the extension portion is inserted in the assembly cavity; and a rear end of the extension portion faces a rear wall of the assembly cavity.

5. The refrigerator door with the replaceable door surface according to claim 4, wherein the elastic member is disposed between the holding frame and the rear wall of the assembly cavity.

6. The refrigerator door with the replaceable door surface according to claim 4, wherein when the mater is inserted in the cross hole, the magnetic ring, and the axial through hole of the holding frame, the plurality of balls clamps the mater, and an inner wall of the extension portion limits the displacement of the plurality of balls in the vertical direction.

7. The refrigerator door with the replaceable door surface according to claim 1, wherein the mater is a hanging pin disposed on the rear side of the decorative door plate; and the hanging pin comprises a recess, in which the plurality of balls is clamped.

* * * * *